United States Patent [19]

Robinson

[11] 4,333,294

[45] Jun. 8, 1982

[54] HERRINGBONE STRUTS

[75] Inventor: Brian Robinson, Usk, Wales

[73] Assignee: Catnic Components Limited, Caerphilly, Wales

[21] Appl. No.: 130,963

[22] Filed: Mar. 17, 1980

[51] Int. Cl.[3] ..... E04C 3/18

[52] U.S. Cl. ..... 52/695

[58] Field of Search ..... 52/695, 693, 694, 696, 52/630

[56] References Cited

U.S. PATENT DOCUMENTS

| | | | |
|---|---|---|---|
| 1,655,234 | 1/1928 | Miller | 52/695 |
| 1,663,487 | 3/1928 | Smith et al. | 52/695 |
| 2,353,073 | 7/1944 | Pitou | 52/695 |
| 2,565,875 | 8/1951 | Musacchia | 52/695 |
| 2,803,045 | 8/1957 | Horner | 52/695 |
| 2,867,854 | 1/1959 | Aiken | 52/695 |

*Primary Examiner*—Reinaldo P. Machado
*Attorney, Agent, or Firm*—Michael W. York

[57] ABSTRACT

The invention relates to herringbone struts, in particular to such a strut made from a single piece of metal and having a cross-section of generally 'M'-shape in transverse cross-section with end flanges which are inclined at angles of greater than 90° to the longitudinal axis of the strut so that in use the strut is inclined when it is secured between two joists.

2 Claims, 3 Drawing Figures

HERRINGBONE STRUTS

FIELD OF THE INVENTION

The invention relates to herringbone struts and to structures incorporating them.

PRIOR ART

Presently, most timber floors including joists incorporate a form of herringbone strut to stiffen individual joists by providing support from adjacent joists when any individual joist is loaded to a degree where deflection is likely to occur. This form of stiffening has been used for many years and is a traditional building technique. In the past, such stiffening was often provided from suitable timber found on site surplus to normal requirements. Of more recent times strutting has been specially made to order. Generally, the strutting is achieved by two individual timber struts located between adjacent joists in the form of crossing diagonals the struts being arranged at intervals across the main span of the joists and one extending from a lower corner of one joist to an upper corner of the other and the other extending from the upper corner of the one joist to the lower corner of the other. Occasionally, however, but serving the same purpose instead of two individual struts in the form of a cross, a solid length of timber having similar dimensions to the joists bridges the gap between the joists.

In spite of increasing costs, herringbone struts are still used to stiffen and strengthen floor joists. I have invented a new, relatively inexpensive and simple to use herringbone strut.

SUMMARY OF THE INVENTION

It is an object of the invention to provide a herringbone strut which has a substantially elongate body with integral end flanges which are directed in opposite directions with respect to the longitudinal extent of the body.

It is a further object of the invention to provide such a strut in which said flanges are each inclined at an angle of greater than 90° to the said longitudinal extent.

It is a yet further object of the invention to provide a herringbone strut which has a substantially 'M' configuration in cross-section.

An embodiment of the invention is hereinafter described, by way of example, with reference to the accompanying drawings.

AS SHOWN ON THE DRAWINGS

Figure 1:
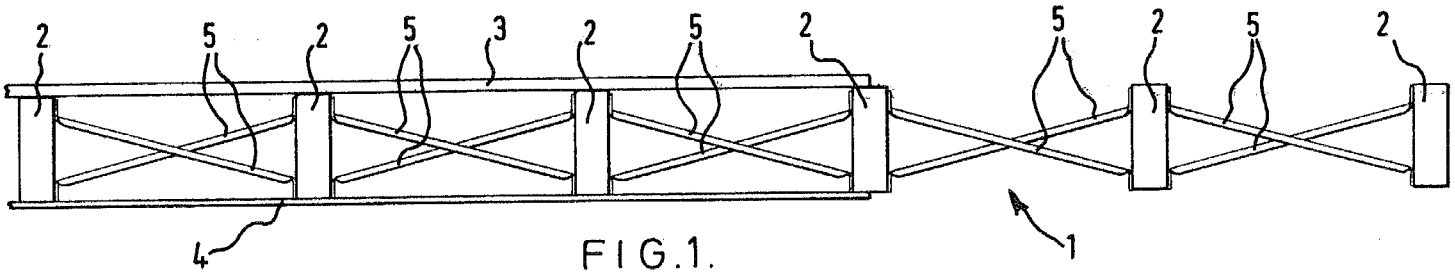
FIG. 1 is an end elevation of the general arrangement of a floor.
Figure 2:
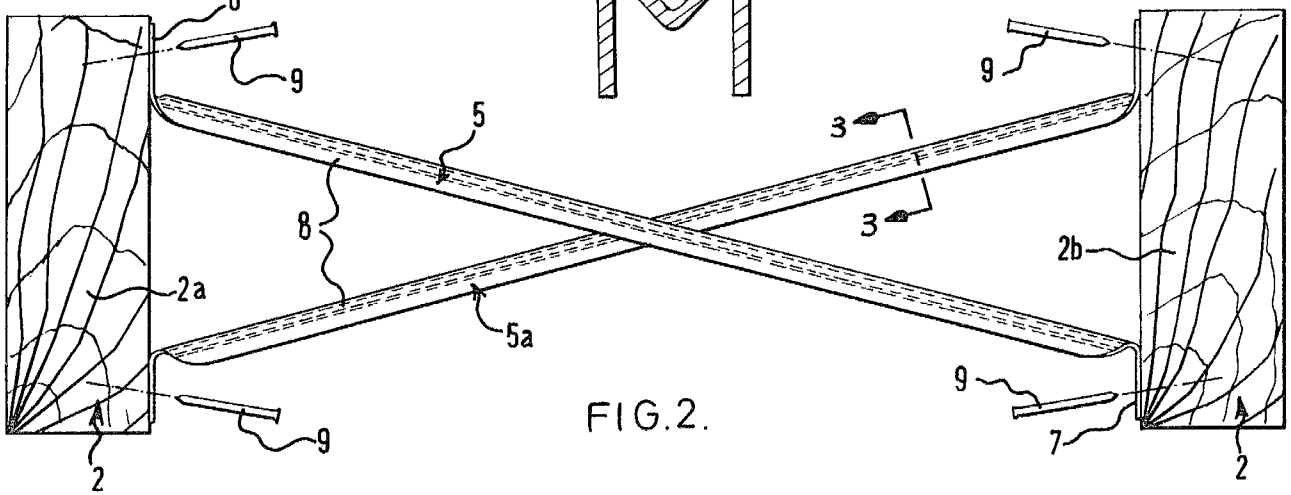
FIG. 2 is, to a larger scale, an end elevational view of a herringbone strut arrangement between two adjacent joists of the floor.

FIG. 1 shows a floor comprising a series of generally parallel wooden spaced-apart floor joists 2 comprising essentially baulks of timber. The joists 2 are supported by walls (not shown) of a building, (also not shown). Flooring such as floor boards 3 is supported on top of the joists 2 while a ceiling construction such as ceiling boards 4 is secured as by pinning to the undersurfaces of the joists 2. A cavity is formed between the floor and ceiling 4, both of which are supported by the joists 2. The joists 2 are relatively long and can move, for example they can twist because of loads imposed from above, or due to settling of the building in which they are installed. If the joists 2 move, as by twisting for example, the flooring 2 and ceiling 4 can be disrupted and can in extreme cases, be destroyed. The ceiling 4 may fall down, for example. In order to prevent or hinder this occurrance from arising, two adjacent joists 2 are connected by a metal herringbone strut 5 which has a configuration such that a flange 6 at one end is higher on the one joist than is the opposite end flange 7 joined to the other joist. In the embodiment shown there are two herringbone struts 5 and 5*a* (FIG. 2) secured to the joists 2*a* and 2*b* at a position about half way along the joists 2*a* and 2*b*. The struts 5 and 5*a* are identical, the strut 5*a* being rotated through 180° with respect to strut so that the 'X'-configuration shown is achieved. The struts 5 and 5*a* do not touch.

Each strut 5 and 5*a* is formed from one piece of metal and has an elongate body 8 of substantially 'M' shape in transverse cross-section. The elongate body 8 has a longitudinal axis about which it is symetrical, in other words the body on one side of the longitudinal axis is a mirror image of the other side of the longitudinal axis. The two end flanges 6 and 7 are integral with the body. The free ends of the flanges 6 and 7 point in opposite directions, that is the flange 6 of the strut 5 points upwardly (as viewed) and the flange 7 downwardly (again as viewed). The limbs of the 'M'-shape point downwardly, as viewed, in both herringbone struts when they are in position between the joists.

Figure 3:
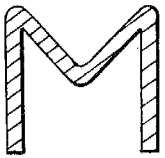
FIG. 3 is an enlarged sectional view of a herringbone strut illustrated in FIG. 2 taken on the line 3—3 thereof.

As illustrated in FIG. 3 for the strut 5*a*, both of the struts 5 and 5*a* are symmetrical about their longitudinal axes and they have a substantially M shaped transverse cross section. The lower ends of the legs of the M shaped cross section both lie in one plane and the upper ends of the legs of the M shaped cross section both lie in another plane which is substantially parallel to the plane containing the lower ends of the legs of the M shaped cross section. The bottom of the middle section of the M of the M shaped cross section is located at a point that is substantially mid-way between the plane containing the lower ends of the legs of the M shaped cross section and the plane containing the upper ends of the legs of the M shaped cross section.

There is an angle of greater than 90° between the flanges 6 and 7 and the body 8, to accommodate the inclined fixing of the struts 5 and 5*a*.

The flanges or legs of the 'M' shaped struts comprise means to prevent torsional buckling of the struts, the channel shape between the legs giving strength so that the struts are light yet strong and reistant to bending.

The struts 5 and 5*a* are secured to the joists 2*a* by fixing means such as pins or nails 9 which are inserted at an angle through the flanges 6 and 7 into the joists. The flanges 6 and 7 may have holes to receive the pins or nails 9. Alternatively the flanges 6 and 7 may be sufficiently thin for the pin or nail to be hammered through the flanges into the joists.

The struts 5 and 5*a* brace the joists 2 and hold them together in the required position so that they do not move as by twisting in torsion.

I claim:

1. A joist interconnecting strut member for securing between two adjacent joists of a building structure, comprising: an elongated body member having respective ends and a longitudinal axis having a substantially M shaped transverse cross section including means for preventing torsional buckling of said strut member comprising the legs of said M shaped cross section; the lower ends of the legs of said M shaped cross section both lying in one plane, the upper ends of the legs of said M shaped cross section both lying in another plane substantially parallel to the plane containing the lower ends of the legs of said M shaped cross section, the bottom of the middle section of the M of said M shaped cross section being located at a point substantially mid-way between the plane containing the lower ends of the legs of said M shaped cross section and the plane containing the upper ends of the legs of said M shaped cross section; a flange at one of said ends and a flange at the other of said ends; said flanges being directed in opposite directions as considered from said longitudinal axis; and said flanges being inclined at an angle of greater than ninety degrees with respect to said longitudinal axis of said elongated body member.

2. A building structure comprising a plurality of spaced apart, substantially parallel joists each having an upper surface and a lower surface, adjacent joists being connected by two interconnecting strut members arranged in a substantially X type configuration between said joists, each of said joist interconnecting strut members comprising: an elongated body member having respective ends and a longitudinal axis and being symetrical about its longitudinal axis; said elongated body member having a substantially M shaped transverse cross section including means for preventing torsional buckling of said strut member comprising the legs of said M shaped cross section; the lower ends of the legs of said M shaped cross section both lying in one plane, the upper ends of the legs of said M shaped cross section both lying in another plane substantially parallel to the plane containing the lower ends of the legs of said M shaped cross section, the bottom of the middle section of the M of said M shaped cross section being located at a point substantially mid-way between the plane containing the lower ends of the legs of said M shaped cross section and the plane containing the upper ends of the legs of said M shaped cross section; a flange at one of said ends and a flange at the other of said ends; said flanges being directed in opposite directions as considered from said longitudinal axis; and said flanges being inclined at an angle of greater than ninety degrees with respect to said longitudinal axis of said elongated body member, said joist interconnecting strut members being located with respect to said joists in order that the lower ends of the legs of said M shaped cross section point downwardly toward the lower surface of said joists.

* * * * *